US006710274B2

(12) United States Patent
Whetzel et al.

(10) Patent No.: US 6,710,274 B2
(45) Date of Patent: Mar. 23, 2004

(54) ELECTRICAL SWITCH ACTUATOR

(76) Inventors: Chris Whetzel, 5422 Rue Deville, Apt. C, Indianapolis, IN (US) 46220; Eric Von Fossen, 305 Orizaba Ave., San Francisco, CA (US) 94132

( * ) Notice: Subject to any disclaimer, the term of this patent is extended or adjusted under 35 U.S.C. 154(b) by 0 days.

(21) Appl. No.: 10/172,362

(22) Filed: Jun. 14, 2002

(65) Prior Publication Data

US 2003/0015410 A1 Jan. 23, 2003

Related U.S. Application Data

(60) Provisional application No. 60/298,627, filed on Jun. 14, 2001.

(51) Int. Cl.[7] ..... H01H 3/20
(52) U.S. Cl. ..... 200/330; 200/331
(58) Field of Search ..... 200/330, 331, 200/333, 338, 339, 329, 334

(56) References Cited

U.S. PATENT DOCUMENTS 4,597,505 A * 7/1986 Mozley et al. ..... 220/89.2
4,825,686 A * 5/1989 Marsh ..... 73/40
5,603,141 A * 2/1997 Gledhill ..... 16/86 A
5,806,665 A 9/1998 Houssian
6,218,995 B1 * 4/2001 Higgins et al. ..... 343/719
6,328,363 B1 * 12/2001 Larsen ..... 294/64.1

* cited by examiner

*Primary Examiner*—Michael Friedhofer
*Assistant Examiner*—Lisa Klaus
(74) *Attorney, Agent, or Firm*—Hahn Loeser + Parks LLP; Stephen L. Grant

(57) ABSTRACT

A decorative electrical switch actuator (50, 150) acts in combination with a conventional light switch (10) having a toggle switch arm (12) mounted in a base such that when the toggle switch arm pivots from a first position to a second position, electrical contacts in the base are moved from a contacting condition to a non-contacting condition or vice versa. The decorative switch actuator has a face plate (52), an actuating assembly (54), and a cap assembly (56, 156). The actuating assembly is mounted on the face plate, and has a means (106) for receiving the toggle switch arm such that a linear movement of the receiving means moves the toggle switch arm from the first to the second position or vice versa. The cap assembly (56, 156) is mounted on the face plate, and is structurally independent of the actuator.

13 Claims, 5 Drawing Sheets

ELECTRICAL SWITCH ACTUATOR

This application claims the benefit of Provisional application No. 60/298,627 filed Jun. 14, 2001.

The present invention relates to an actuator for an electrical switch, particularly a standard wall toggle switch. The present invention provides a decorative yet functional alternative to the toggle switch, the invention providing a fluid switching motion between the ends of the range of motion of the toggle switch.

BACKGROUND OF THE ART

The standard wall toggle switch is well known in the United States and in many other countries. This type of switch is used to control electric current flow to electrical outlets, lights, ceiling fans and the like. U.S. Pat. No. 5,806,665 to Houssian distinguishes itself from some prior art actuators or switch covers in that Houssian teaches a switch actuator that moves in a circular arc motion rather than linearly. Since the toggle switch arm is a lever that is pinned to and pivots about a central point, the end of the arm away from the pivot point moves in a circular arc with respect to that point. The linear actuators do not move smoothly through their range of motion when required to accommodate this arcuate action of the arm end. In Houssian, the actuator is seated atop the arm end and rides in a channel on an arcuate face plate or cover, albeit one with a larger radius of curvature than that of the toggle arm end.

Certainly a large number of design alternatives are available to the person who is willing to disconnect the electrical contacts to the standard toggle switch assembly, remove that switch assembly from the housing and replace the entire switch assembly. Such persons may, for example, install a switch that offers a resilient "on-off" compression member in combination with a rheostatically controlled rotary element that dims or brightens the light.

A reason for inventions such as Houssian is to provide efficient yet attractive alternatives to the toggle switch while not requiring the installer to work with the electrical connections. An advantage of the present invention is to provide another such alternative.

SUMMARY OF THE INVENTION

This advantage and others are provided by a device for actuating an electrical switch having a toggle switch arm mounted in a base such that when the toggle switch arm pivots from a first position to a second position, electrical contacts in the base are moved from a contacting condition to a non-contacting condition or vice versa. The device comprises a face plate, an actuating assembly and a cap assembly. The actuating assembly is mounted on the face plate. It comprises a means for receiving the toggle switch arm such that a linear movement of the receiving means moves the toggle switch arm from the first to the second position or vice versa. The cap assembly is mounted on the face plate, and is structurally independent of the actuating assembly.

In some embodiments of the device, the cap assembly is a singular piece, comprising a cap.

In other embodiments, the cap assembly comprises an annular ring, mountable in the face plate, and a cap, mountable on the annular ring.

BRIEF DESCRIPTION OF THE DRAWINGS

The present invention will be better understood when reference is made to the accompanying drawings, wherein identical parts are identified with identical reference numerals and wherein.

DETAILED DESCRIPTION OF THE INVENTION

Figure 1:
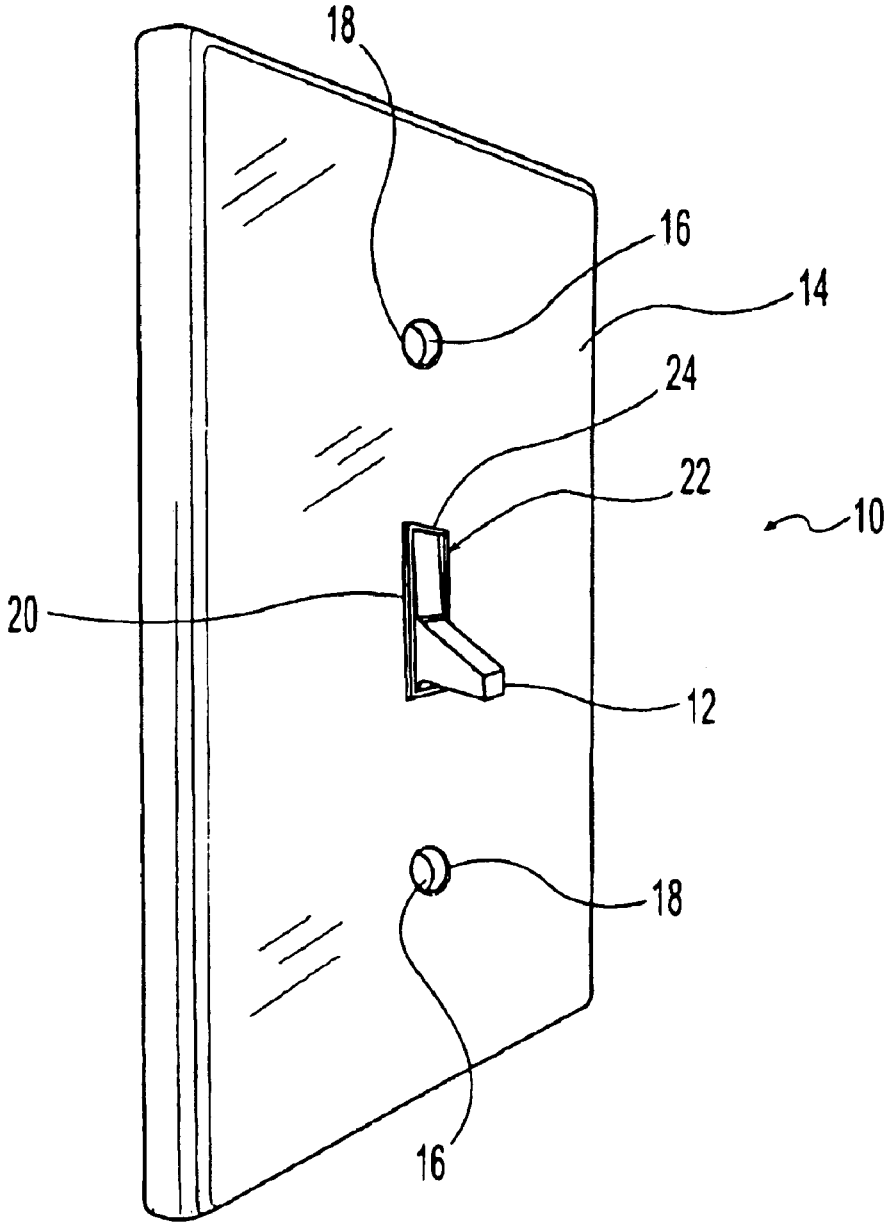
Fig. 1 (Prior Art)
FIG. 1 shows a standard toggle switch.

The standard wall toggle switch 10 known in the prior art is shown in FIG. 1. In this switch 10, the arm 12 is pivotably mounted in a base of the switch, the base containing electrical contacts capable of making and breaking an electrical circuit as the arm moves from a first position to a second position or vice versa. The range of motion of the arm 12 in going from either end position to the other is about thirty degrees. The switch 10 conventionally has a face plate 14 which is generally parallel to and offset from a wall W in which the switch 10 is mounted. This face plate 14 is conventionally attached to the switch 10 by a pair of screws 16, the screws passing through the face plate in holes 18. Additionally, a larger hole 20 allows passage of the arm 12 therethrough, the arm being conventionally seated in an arm housing 22 with a rectangular face 24 that is slightly smaller than the hole 20. Removal and replacement of the face plate 14 presents only an extremely remote danger of electrical shock to the person making the replacement.

Figure 2:
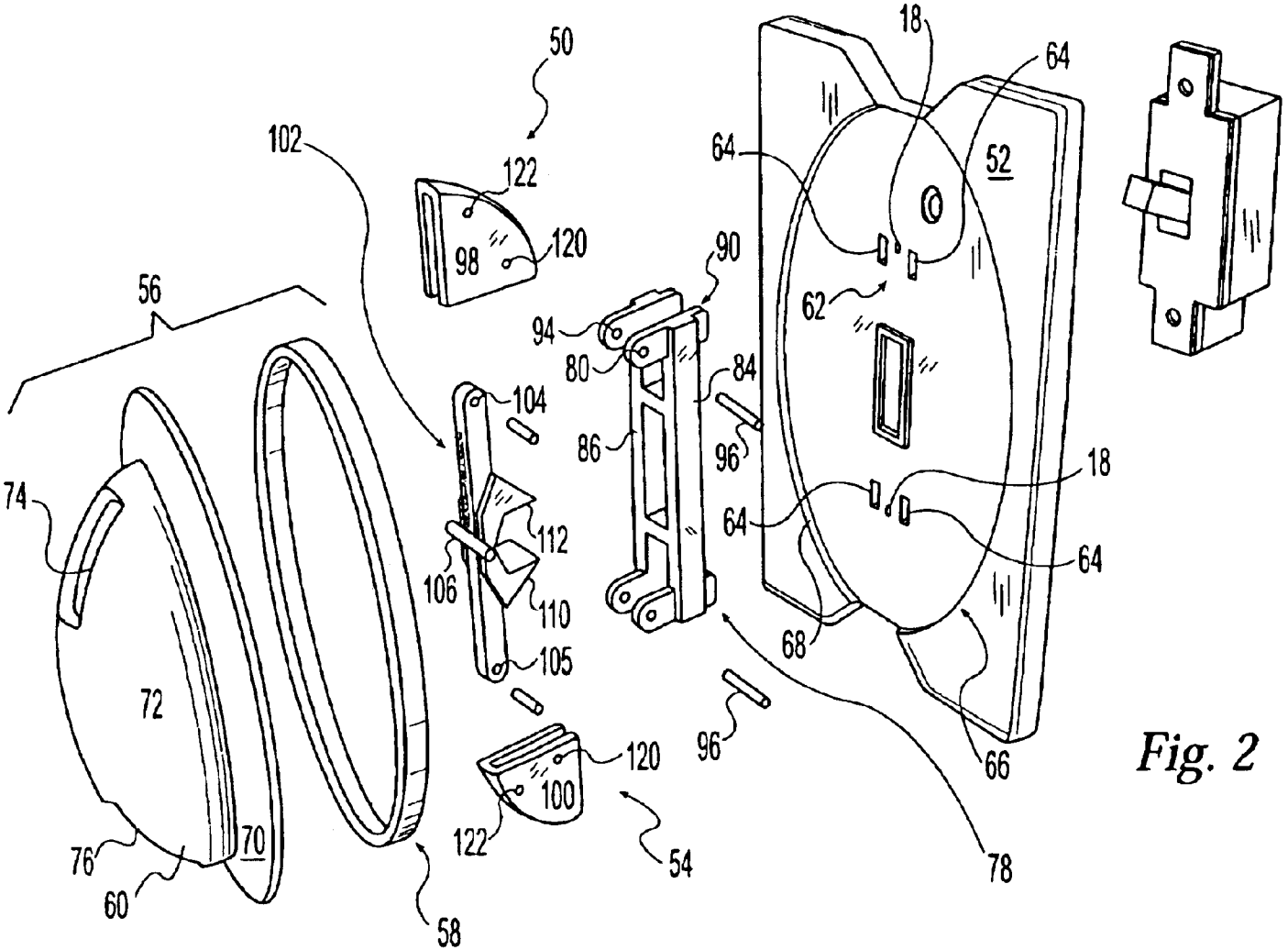
FIG. 2 shows an exploded view of the actuator of a first embodiment of the present invention.
Figure 3:
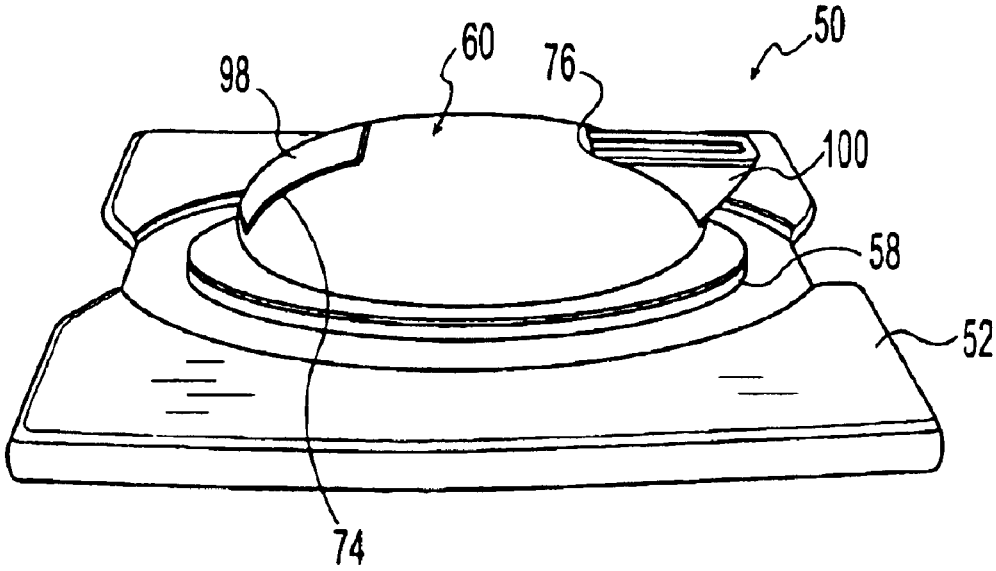
FIG. 3 shows an external view of the assembled actuator of the first embodiment of the present invention.

The light switch actuator 50 of a first embodiment of the present invention is now shown in FIGS. 2 and 3. FIG. 2 shows an exploded view of the components and FIG. 3 shows an assembled view. The actuator 50 comprises a face plate 52, an actuating assembly 54 and a cover or cap assembly 56. In the particular embodiment shown, the cover or cap assembly 56 actually comprises two separate pieces, the first being an elliptical annular ring 58 and the second being a cap 60. It will be understood that in some embodiments, the cap assembly 56 will consist only of a single part comprising all the features of the ring 58 and the cap 60.

Attention is now directed to the face plate 52, which is different from the face plate 14 of the prior art. Face plate 52 has a pair of holes 18 which correspond to the holes 18 in the prior art face plate 14 and a hole 20 which corresponds to the arm housing receiving hole 20 of the prior art face plate. Particularly, the face plate 52 is also provided with a means 62 for receiving and retaining the actuating assembly 54. In the specific embodiment illustrated, the receiving and retaining means 62 is a set of rectangular holes 64, with a pair of such holes straddling each of the holes 18. The face plate 52 also is provided with a means 66 for receiving and retaining the cap assembly 56. In the particular embodiment shown, the receiving and retaining means 66 is an elliptical ridge 68, particularly one molded into the upper surface of the face plate 52.

Further attention to FIG. 2 shows details of the cap assembly 56, which comprises the elliptical annular ring 58 and the cap 60. Elliptical annular ring 58 is generally unremarkable, but it will be provided with means so that it will assist the face plate 52 in receiving and retaining the cap 60. Absent such means being provided, the elliptical annular ring 58 will not be included in the cap assembly 56. Cap 60 is shown as comprising an elliptical base 70 upon which is based a dome member 72. In the particular embodiment shown, this dome member 72 is shaped as one-half of a solid of rotation of an ellipse. The dome member 72 is effectively hollow, the thickness of the wall that defines both the dome member and the elliptical base being effectively constant. This hollow dome member 72 thereby provides a cavity within which the toggle arm 12 may move freely within its normal range of motion. The dome member 72 has a first and a second cutout portion 74, 76, the use of which will become obvious as further description is provided.

Attention is now directed to the actuating assembly 54, which has a base 78 with first and second ends 80, 82. Connecting arms 84, 86, join the first and second ends 80, 82, to provide structural stability. Each end 80, 82, is also provided with means 90 corresponding with the means 62 for receiving and retaining on the face plate 52. In the embodiment illustrated, the means 90 is a set of legs of rectangular cross-section. Each end 80, 82, is also provided with a pair of spaced apart, upstanding legs 94. These legs 94 define a clevis for supporting a pivot bar 96. A first pivot element 98 is held in the clevis formed by the upstanding legs 94 at the first end 80 of the actuating assembly 54 and a second pivot element 100 is held in the clevis formed by the upstanding legs 94 at the second end 82 thereof. A bar member 102 has its first end 104 pinned into the first pivot element 98 and its second end 105 pinned into the second pivot element 100, so that pivoting motion of either pivot element causes co-action in the other pivot element. A means 106 for receiving the toggle arm 12 is positioned on an intermediate portion of the bar member 102. In this manner, the pivoting motion of either of the pivot elements 98, 100, results in motion of the toggle arm 12. The toggle arm receiving means is shown in the embodiment as a pair of downwardly extending tangs or posts 108, 110, with an intermediate cavity or cradle 112 into which the toggle arm 12 is seated. When the actuating assembly 54 is properly constructed, a pivoting rotation of either the first or second pivot element 98, 100, through about 90 degrees will result in a full range motion of about thirty degrees in the toggle arm 12. Each of the pivot elements 98, 100, pivot in the same direction, so that, in the embodiment shown, a counterclockwise rotation of the pivot elements moves the toggle arm 12 counterclockwise and a clockwise rotation of the pivot elements moves the toggle arm clockwise. It will also be appreciated that the bar member 102 remains generally parallel to the face plate 52 as it moves through its range of motion, with the bar member being closest to the face place at the ends of the range and farthest from the face plate at the middle of the motion.

Further attention is now directed to the pivot elements 98, 100, which, in the embodiment shown, are mirror images of each other. Each pivot element 98, 100 has a first pivot point 120 and a second pivot point 122. The respective first pivot points 120 provide the pivot between the pivot element 98, 100 and the upstanding legs 94 of the bridging assembly. the respective second pivot points 122 provide the pivot between the pivot element 98, 100 and the respective ends 104 of the bar member 102. A periphery of each of the pivot elements 98, 100, is irregular when viewed from the side and the first pivot point 120 is offset from a center of the planar surface defined by the periphery. Because of this, a portion 124 of each pivot element 98, 100, can extend outwardly through one of the cutout portions 74, 76 when the pivot element is in one position, but the pivot element 98, 100 will be effectively flush with the surface of the dome member when the pivot element is in a second position.

It will be understood from the foregoing that when pivot element 98 is in the first position, the pivoting of it about its first pivot point moves pivot element 98 to the second or flush position and the action of bar member 102 not only moves the toggle arm, but also changes pivot element 100 from the second or flush position to the first or outwardly extended position. FIG. 3 shows an example of this situation with pivot element 98 in the flush position and pivot element 100 in the extended position.

While this motion of the pivot elements should move smoothly, it may be desirable in some embodiments to connect the bar member 102 to the face plate 52 or the actuating assembly 54 with a biasing means, such as a spring. This biasing means will urge the bar member 102 to be in one of the ends of its range of motion rather than in any intermediate position, meaning that the toggle arm 12 will likewise be at one end of its motion range also, rather than being in an intermediate position.

Figure 4:
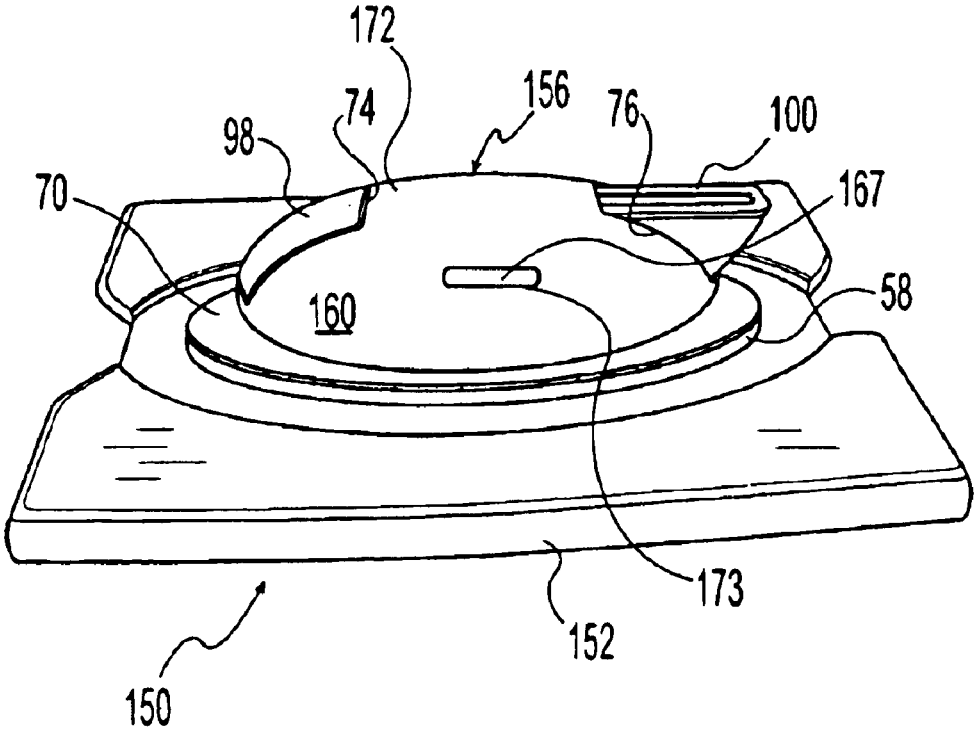
FIG. 4 shows an external view of the assembled actuator of a second embodiment of the present invention.
Figure 5:
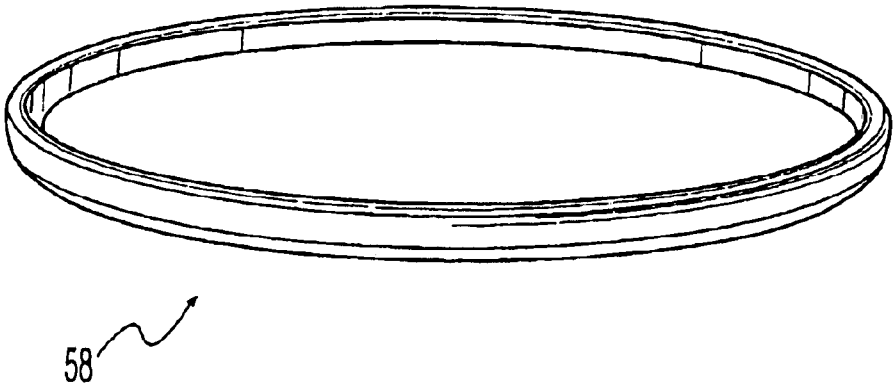
FIG. 5 shows an isolated view of the ring of either the first or second embodiment device.
Figure 6:
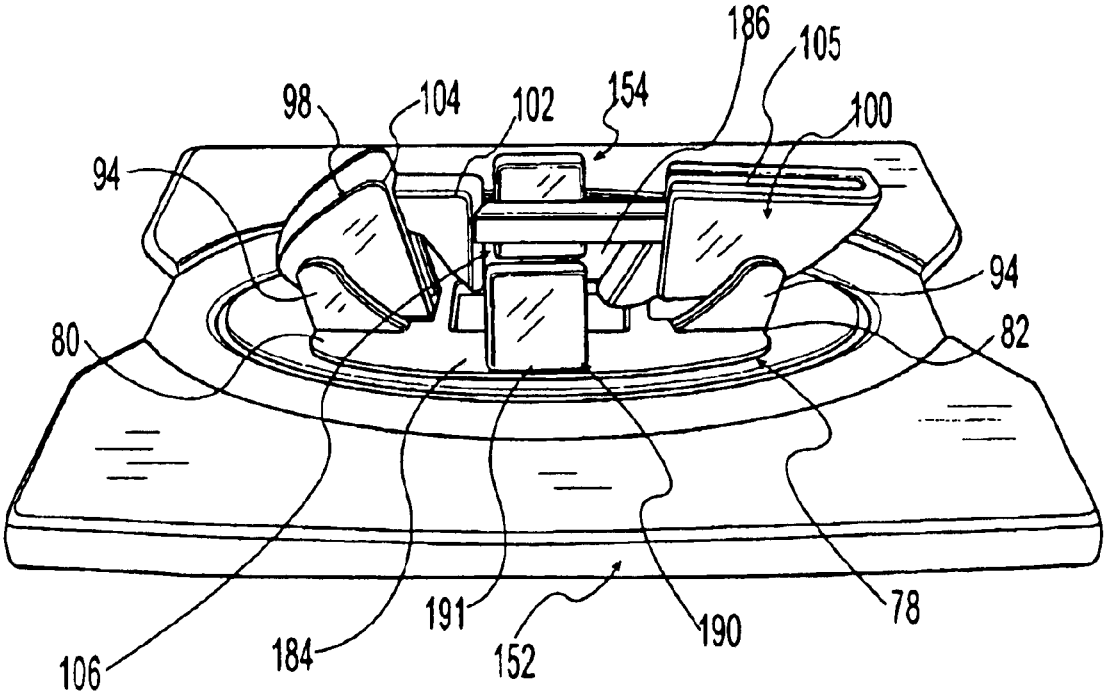
FIG. 6 shows an assembled view of the face plate and actuator of the second embodiment, with the cap assembly removed.
Figure 7:
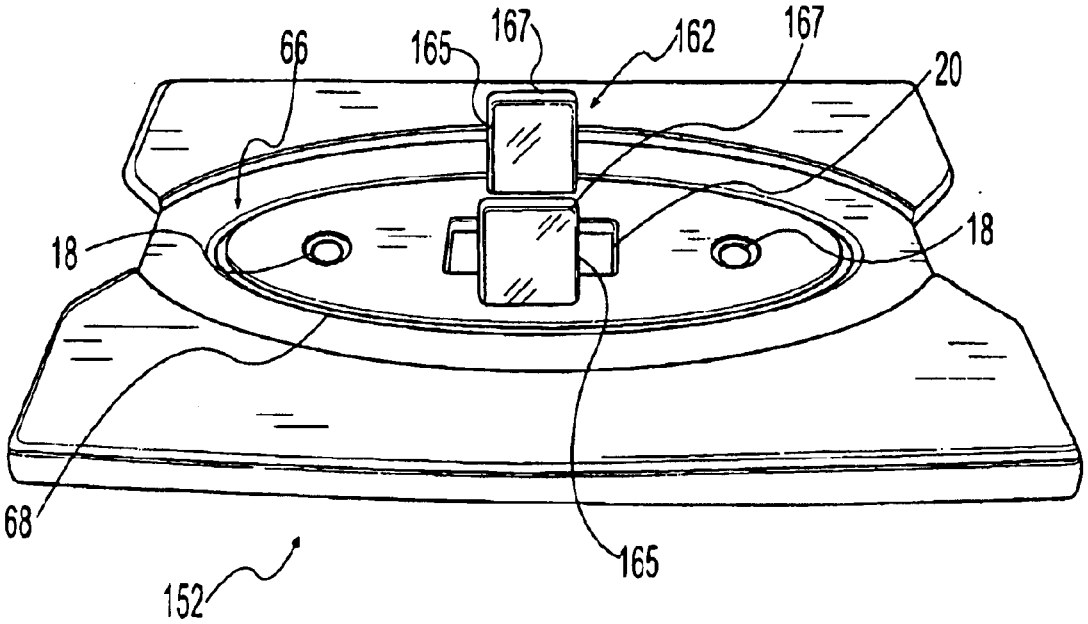
FIG. 7 shows an isolated view of the face plate of the second embodiment, with the actuator removed.
Figure 8:
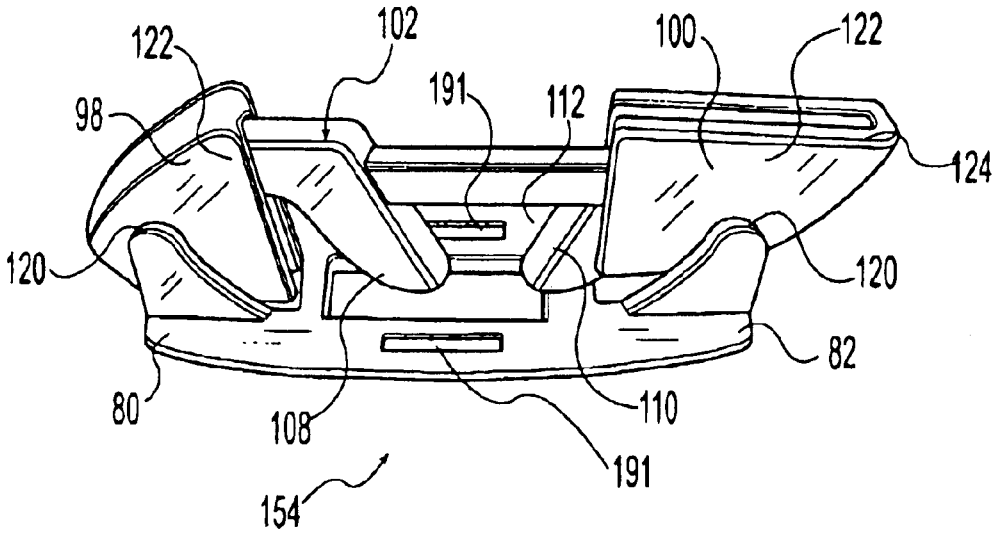
FIG. 8 shows an isolated view of the bridging assembly.

A second embodiment of the light switch actuator 150 is now shown in FIGS. 4 through 8. This actuator 150 comprises a face plate 152, a actuator 154 and a cover or cap assembly 156. In the particular embodiment shown, the cover or cap assembly 156 actually comprises two separate pieces, the first being an elliptical annular ring 58 and the second being a cap 160. It will be understood that in some embodiments, the cap assembly 156 will consist only of a single part comprising all the features of the ring 58 and the cap 160. The assembled device 150 is shown in FIG. 4, in a manner similar to FIG. 3 for the first embodiment. FIG. 5 shows the ring 58 in isolation. FIG. 6 shows the face plate 152 and actuator 154 together. FIG. 7 shows the isolated face plate 152 and FIG. 8 shows the isolated actuator 154.

Attention is now directed to the face plate 152, which is different from the face plate 14 of the prior art. Face plate 152 has a pair of holes 18 which correspond to the holes 18 in the prior art face plate 14 and a hole 20 which corresponds to the arm housing receiving hole 20 of the prior art face plate. Particularly, the face plate 152 is also provided with a means 162 for receiving and retaining the actuator 154. Unlike the first embodiment, in which the receiving and retaining means 62 is a set of rectangular holes 64, the receiving and retaining means 162 on the face plate 152 is a pair of upstanding legs 165. Instead of straddling the holes 18, the legs 165 straddle hole 20, so they are more centrally positioned. In the embodiment shown, the legs 165 are not parallel to each other, but they are positioned so as to splay apart slight as the distance from a point of attachment to the face plate increases. Further, each leg is provided with an enlarged lip or edge 167 at the end of the leg that is distant from the attachment point. These legs 165 interact with corresponding means on the actuator 154 as described in more detail below.

The face plate 152 also is provided with a means 66 for receiving and retaining the cap assembly 56. In the particular embodiment shown, the receiving and retaining means 66 is an elliptical ridge 68, particularly one molded into the upper surface of the face plate 152. This means may be accompanied by an even further or second means for receiving and retaining the cap assembly, that further means being the upstanding legs 165, or more particularly, the edges or lips 167 on the legs. This second means is also described in more detail below.

Further attention to FIG. 4 shows details of the cap assembly 156, which comprises the elliptical annular ring 58 and the cap 160. Elliptical annular ring 58 is generally unremarkable, but it will be provided with means so that it will assist the face plate 52 in receiving and retaining the cap 160. Absent such means being provided, the elliptical annular ring 58 will not be included in the cap assembly 56. Cap 160 is shown as comprising an elliptical base 70 upon which is based a dome member 172. In the particular embodiment shown, this dome member 172 is shaped as one-half of a solid of rotation of an ellipse. The dome member 172 is effectively hollow, the thickness of the wall that defines both the dome member and the elliptical base being effectively constant. This hollow dome member 172 thereby provides a cavity within which the toggle arm 12 may move freely within its normal range, of motion. The dome member 172 has a first and a second cutout portion 74, 76, the use of which will become obvious as further description is provided.

Dome member 172 differs from dome member 72 of the first embodiment in that it is further provided on the inside surface with a pair of linear depressions or detents 173 which correspond spatially to the lips or edges 167 of the upstanding legs 165 when the dome member is properly seated on the face plate 152. The depressions or detents coact with the edges 167 to frictionally hold the dome member and the face plate in proper position.

Attention is now directed to the actuator 154, which has a base 78 with first and second ends 80, 82. Connecting arms 184, 186, join the first and second ends 80, 82, to provide structural stability. Each connecting arm 184, 186 is provided with means 190 corresponding with the means 162 for receiving and retaining on the face plate 152. In the second embodiment, the means 190 is a pair of holes 191, one such hole in each connecting arm 184, 186 so that one of the upstanding legs 165 may be passed through the hole 191. The slight outward splay of the legs 165 relative to each other urges the actuator 154 against the face plate 152, securing it in place. As in the first embodiment, each end 80, 82, is also provided with a pair of spaced-apart, upstanding legs 94. These legs 94 define a clevis for supporting a pivot point. A first pivot element 98 is held in the clevis formed by the upstanding legs 94 at the first end 80 of the actuator 154 and a second pivot element 100 is held in the clevis formed by the upstanding legs 94 at the second end 82 thereof. A bar member 102 has its first end 104 pinned into the first pivot element 98 and its second end 105 pinned into the second pivot element 100, so that pivoting motion of either pivot element causes co-action in the other pivot element. A means 106 for receiving the toggle arm 12 is positioned on an intermediate portion of the bar member 102. In this manner, the pivoting motion of either of the pivot elements 98, 100, results in motion of the toggle arm 12. The toggle arm receiving means is shown in the embodiment as a pair of downwardly extending tangs or posts 108, 110, with an intermediate cavity or cradle 112 into which the toggle arm 12 is seated. When the actuator 154 is properly constructed, a pivoting rotation of either the first or second pivot element 98, 100, through about 90 degrees will result in a full range motion of about thirty degrees in the toggle arm 12. Each of the pivot elements 98, 100, pivot in the same direction, so that, in the embodiment shown, a counterclockwise rotation of the pivot elements moves the toggle arm 12 counterclockwise and a clockwise rotation of the pivot elements moves the toggle arm clockwise. It will also be appreciated that the bar member 102 remains generally parallel to the face plate 52 as it moves through its range of motion, with the bar member being closest to the face place at the ends of the range and farthest from the face plate at the middle of the motion.

As in the first embodiment, the pivot elements 98, 100 are mirror images of each other. Each pivot element 98, 100 has a first pivot point 120 and a second pivot point 122. The respective first pivot points 120 provide the pivot between the pivot element 98, 100 and the upstanding legs 94 of the bridging assembly. The respective second pivot points 122 provide the pivot between the pivot element 98, 100 and the respective ends 104, 105 of the bar member 102. A periphery of each of the pivot elements 98, 100, is irregular when viewed from the side and the first pivot point 120 is offset from a center of the planar surface defined by the periphery. Because of this, a portion 124 of each pivot element 98, 100, can extend outwardly through one of the cutout portions 74, 76 when the pivot element is in one position, but the pivot element 98, 100 will be effectively flush with the surface of the dome member when the pivot element is in a second position.

It will be understood from the foregoing that the when pivot element 98 is in the first position, a pivoting of it about its first pivot point moves pivot element 98 to the second or flush position and the action of bar member 102 not only moves the toggle arm, but also changes pivot element 100 from the second or flush position to the first or outwardly extended position. FIG. 4 shows an example of this situation with pivot element 98 in the flush position and pivot element 100 in the extended position.

While this motion of the pivot elements should move smoothly, it may be desirable in some embodiments to connect the bar member 102 to the face plate 52 or the actuating assembly 54 with a biasing means, such as a spring. This biasing means will urge the bar member 102 to be in one of the ends of its range of motion rather than in any intermediate position, meaning that the toggle arm 12 will be at one end of its motion range also, rather than being in an intermediate position.

In the first embodiment, the pinning of the pivot elements 98, 100 to the upstanding legs 94 and the bar member 102 is accomplished by pins, typically a metal pin 96 passing through holes in the respective parts, as illustrated in FIG. 2. However, it is also possible to provide tangs on one of the parts, the tangs fitting into the hole and effectively replacing the pivot bar.

It will be further understood from the foregoing that all elements of the present invention responsible for switching the toggle arm 12 from one position to the other are structurally independent from the cap assembly.

It is known in the prior art to have a light source, typically a small incandescent bulb or even a light emitting diode ("LED") light installed in a light switch, especially behind the face plate of a conventional wall switch. In some instances, especially with dimmer switches, the light that is installed is lighted when the switch is in the open or "off" position and is not lighted when the switch is in the closed or "on" position. Because the present invention teaches a light switch actuator involving a cap assembly that covers over the toggle arm, there i sat least as much room for installation of such a light source. While the prior art the tendency has been to use alternating current available in the house electrical supply to power the light source, the increasing use of small "button"-type batteries suggests that they could be used in this application.

What is claimed is:

1. A device for actuating an electrical switch having a toggle switch arm mounted in a base such that when the toggle switch arm pivots from a first position to a second position, electrical contacts in the base are moved from a contacting condition to a non-contacting condition or vice versa, said device comprising:

a face plate;

an actuating assembly, mounted on the face plate, the actuating assembly comprising a means for receiving the toggle switch arm such that a linear movement of the receiving means moves the toggle switch arm from the first to the second position or vice versa; and a cap assembly, mounted on the face plate, and structurally independent of the actuator.

2. The device of claim 1, wherein the cap assembly is a cap.

3. The device of claim 2, wherein the face plate further has a hole for allowing passage of the toggle switch arm therethrough.

4. The device of claim 1, wherein the cap assembly comprises an annular ring and a cap.

5. The device of claim 4, wherein the face plate and cap assembly are provided with corresponding means for mounting the annular ring on the face plate and to mount the cap on the annular ring so as to cover the actuating assembly.

6. The device of claim 1, wherein the face plate further comprises a means for attaching the face plate to the switch base.

7. The device of claim 1, wherein the face plate and the actuating assembly are provided with corresponding means for mounting the actuating assembly on the face plate.

8. The device of claim 7, wherein the face plate and cap aseembly are provided with corresponding means for mounting the cap assembly on the face plate so as to cover the actuating assembly.

9. The device of claim 8, wherein the cap is a hollow dome member with a first and a second cut-out aperture.

10. The device of claim 9, wherein the actuating assembly comprises:

a base, with first and second ends;

a pair of connecting aims joining the first and second ends;

a pair of upstanding legs at the first and the second ends, each pair of upstanding legs defining a clevis;

a first and a second pivot element, each pivot element supportably mounted in one of the devises;

a bar member pivotably mounted to the first and the second pivot elements for linear movement between a first and a second end position corresponding to the first and second positions of the toggle switch arm, the toggle switch arm receiving means positioned on an intermediate portion of the bar member.

11. The device of claim 10, wherein at least a portion of the first and the second pivot elements extends outwardly through the respective first and second cut-out apertures of the cap.

12. The device of claim 11, wherein:

the first pivot element is effectively flush with the surface of the cap and the second of the pivot elements extends outwardly from the cap when the toggle arm switch is in the first position, and the second pivot element is effectively flush with the surface of the cap and the first of the pivot elements extends outwardly from the cap when the toggle arm switch is in the second position.

13. The device of claim 12, wherein the actuating assembly further comprises a means for biasing to bias the bar member in the first or second end position.

* * * * *